United States Patent [19]

Paoletti et al.

[11] 4,154,378

[45] May 15, 1979

[54] METERING VALVE FOR PRESSURIZED CONTAINER

[75] Inventors: Charles Paoletti, Aulnay sous Bois; Manlio Maurelli, Vaujours, both of France

[73] Assignee: L'Oreal, Paris, France

[21] Appl. No.: 847,665

[22] Filed: Nov. 1, 1977

[30] Foreign Application Priority Data

Nov. 4, 1976 [FR] France ..... 76 33260

[51] Int. Cl.[2] ..... B65D 83/14

[52] U.S. Cl. ..... 222/394; 222/464

[58] Field of Search ..... 222/211, 335, 321, 382, 222/394, 395, 402.1, 402.2, 425, 444, 492, 464, 434; 239/350, 354

[56] References Cited

U.S. PATENT DOCUMENTS

| | | | |
|---|---|---|---|
| 2,778,543 | 1/1957 | Urlaub | 222/464 |
| 2,815,889 | 12/1957 | Stetz et al. | 222/402.2 |
| 3,104,785 | 9/1963 | Beard | 222/402.2 |
| 3,377,004 | 4/1968 | Kjelson | 222/402.2 |
| 3,502,035 | 3/1970 | Fedit et al. | 222/321 |
| 3,998,364 | 12/1976 | Hollander | 222/464 |

*Primary Examiner*—Robert J. Spar
*Assistant Examiner*—H. Grant Skaggs
*Attorney, Agent, or Firm*—Brisebois & Kruger

[57] ABSTRACT

A metering arrangement for dispensing a predetermined quantity of product each time the dispensing valve of a pressurized container is operated. A flexible wall feed tube within the container is connected to the valve inlet, the tube having a restriction therein. Operating the dispensing valve reduces pressure in the tube, because of the restriction, to dispense the quantity of product, and to cause the tube wall to collapse and create a seal. When the valve is released, the pressure on the inside and outside of the tube equalizes by flow through the restriction.

10 Claims, 2 Drawing Figures

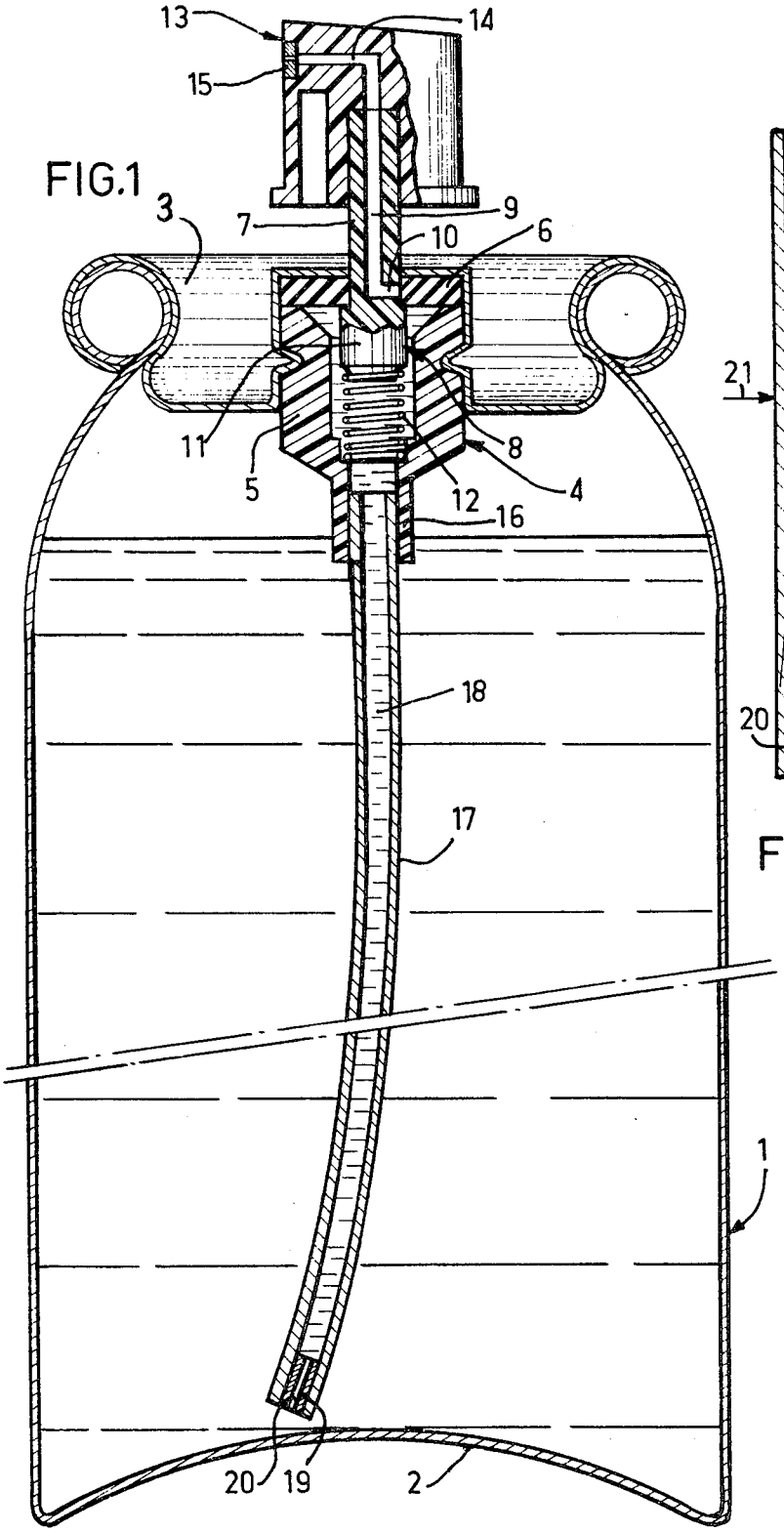
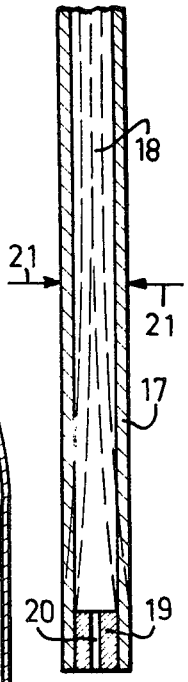
FIG.2

METERING VALVE FOR PRESSURIZED CONTAINER

SUMMARY OF THE INVENTION

One knows that, on pressurized containers of the "aerosol bomb" type, one generally places in the upper part of the container, a dispensing valve which permits the dispensing of the conditioned or packaged product in the container when the user presses on the push button or an analogous device. One likewise knows that one can dispense, each time the push button is depressed, a predetermined quantity of product by using metering valves of known construction.

A first known type of metering valve comprises a valve body inside of which is a slidable atomizer, whose part which emerges from the valve body forms an output tube. In this output tube is an axial channel connected to a radial channel communicating with the interior volume of the valve body during a dispensing operation; the output tube has a flange at its base, which seats, under the effect of the push exerted by a spring, against a sealing disk in the upper part of the valve body. This pressure of the flange on the disk assures a good seal between the inside and the outside of the valve body to normally close the valve. At its lower portion, the atomizer is provided with a closure valve capable of closing the opening of the dip or feed tube entering the inside of the valve body.

When the user presses the push button mounted on the output tube, it causes the depression of the atomizer to the inside of the valve body so the closure valve closes the opening of the feed tube entering the valve body; the closure valve thus sealing between the inside of the valve body and the pressurized container; simultaneously, the flange of the atomizer is spaced from the seal disk and the quantity of the product, contained in the valve body, is released and dispensed. When the user releases the push button, the atomizer returns to its initial position by the action of the spring and the flange comes to bear against the seal disk to assure the closing of the valve; the valve body is then again capable of recharging itself with a dose of product for further dispensing.

Of course, a metering or dosage valve of this type is only capable of functioning when the dose of product to be dispensed and which is contained in the valve body is mixed with a liquid propellant or with the liquid phase of a propellant in a liquid-vapor state at normal temperatures of use of the pressurized container. If one uses a propellant such as a compressed nonliquified gas, nitrogen for example, the valve body then contains only the product to be dispensed which is not then subjected to the action of the propellant at the moment of dispensing and is not able, consequently, to be ejected by pressing down on the output tube. Because of this, a second type of metering valve has been proposed capable of functioning even if the dose of product to be dispensed is not mixed with the propellant. Such a metering device comprises a case of flexible material which surrounds the valve body, the interior volume of the valve body communicating with that of the pliable case. In this case, when the user presses down the atomizer, the interior volume of the pliable case is put at atmospheric pressure and the prevailing pressure inside the container causes the squashing of the wall of the pliable case, which causes the dispensing of the dose of product which is contained in it.

Although these two types of dosage valves generally give satisfactory use, they present the disadvantage of being of relatively complex structure; in fact, these two types require the use of a supplementary closing device such as a closure valve positioned on the atomizer and designed to isolate, during the dispensing operation, the interior volume of the valve body from that of the pressurized container. Moreover, the doses of product dispensed are necessarily very small; in the first type of valve, the dose for dispensing is confined in a valve body of small dimension; in the second type, the dose to be dispensed is certainly much larger but it is necessary to provide a pliable case which has the disadvantage of increasing the manufacturing cost of such a valve.

The present invention has as an object to remedy the above disadvantages and, for this purpose, to disclose a dosage valve functioning without the use of a supplementary closing device and allowing the dispensing of large doses of product. To do this, the present invention provides notably for combining a conventional dispensing valve, not equipped with a metering or dosage device, with a pliable feed tube, partially closed in one zone by a restriction defining a constricted passage. The quantity of product dispensed at a single time is that which is contained both in the valve body and in the part of the feed tube included between the restriction and the valve body. When the user acts on the valve according to the invention, for example, by means of a push button, the dose of product contained in the body of the valve and in the feed tube above the restriction can be expelled because of the squashing of the wall of the tube due to the greater pressure prevailing inside the pressurized container than within the tube. The squashing of the wall of the tube causes not only the dispensing of the product which was contained in it but also the establishment of a seal by the squashed wall between the inside of the container and the valve even if the user does not release his action on the push button. It is fitting to note that the dispensing of a dose of product can be accomplished even if one uses a propellant in the form of a compressed nonliquified gas which is not mixed in the dosage volume of the product to be dispensed.

The present invention has then as an object the new industrial product that constitutes a dosage valve for a pressurized container of the "aerosol bomb" type and to be operated by the user by means of a push button or an analogous operating device to dispense a predetermined quantity of product contained in the container, a feed tube placed inside the container being connected to the valve body, the interior volume of the valve body communicating with the duct of the feed tube, a restriction being provided in one zone of the feed tube, this restriction marking off a section of constricted passage in relation to the interior dimension of the feed tube in its other zones, characterized by the fact that the feed tube is made of an elastically deformable material. In a preferred embodiment, the restriction is positioned at the extremity of the duct of the feed tube which does not connect to the valve body; the restriction is in an undeformable rigid material which takes the form of a pellet joined at its periphery with the feed tube which surrounds it, the pellet having at least one small cross-section passage the length 1 of the passage being large in relation to the largest dimension of its cross-section. If one designates by s the cross-section of the passage hole of the restrictor, and by S the interior cross-section of the feed tube, expressed in the same units, s/S is between 1/400 and 1/150. The passage has a circular section of radius R and the ratio of radius R to length 1 of the passage, i.e., R/1 is between 1/50 and 1/25.

The present invention also has as an object the new industrial product which constitutes a pressurized container of the "aerosol bomb" type comprising a can on which a metering valve is mounted, the said can being designed to contain both the product for dispensing and at least one propellant fluid, characterized by the fact that the metering valve is a valve of the type defined above.

In a first variation, the propellant fluid is a liquified propellant in the liquid state or in the liquid-vapor state at normal temperatures of use of the pressurized container, the liquid phase of the propellant fluid being mixed with the product to be dispensed. In this case, the feed tube can be made of rigid non-deformable material, it being understood that the enclosed dosage volume, that is to say, the volume inside the feed tube and the valve body, can be dispensed by the action of pressure forces developed by the liquified propellant mixed with the product and in the dosage volume. Nevertheless, to assure sealing between the inside of the pressurized container and the feed tube, at the time of a dispensing operation and in order to obtain doses of product essentially equal for each dispensing operation, it is preferable to provide the feed tube with an elastically deformable wall, the squashing or collapsing of the deformable wall assuring the sealing of the feed tube after ejection of the metered volume of product.

In a second embodiment, the propellant fluid is a compressed nonliquified gas, such as nitrogen, for example. In this case, the expulsion of the product contained in the dosage volume situated downstream of the obstruction or restriction at the extremity of the feed tube can only take place by squashing the wall of the feed tube since the product contained in the dosage volume is not mixed with a quantity of propellant capable of assuring its dispensing.

To better understand the objects of the invention, one will now describe, as a purely illustrative and nonlimiting example, a preferred embodiment shown in the attached drawings.

In these drawings:

FIG. 1 shows, in axial section, a pressurized container on which is mounted a metering valve according to the invention, a push button being mounted on the output tube of the valve.

FIG. 2 shows the inner extremity of the feed tube of the metering valve in detail according to the invention, and shows in dotted lines the squashing of the wall of the feed tube during dispensing to assure both the ejection of the dose of product, and isolation or sealing between the inside of the pressurized container and the valve end of the feed tube.

Referring to the drawings, there is shown a pressurized container 1 of the "aerosol bomb" type. This container 1 comprises a bottom 2 and an upper part closed by a valve holder cup 3 in which is mounted a metering valve 4 according to the invention.

The metering valve 4 comprises a valve body 5 fastened at its center to the valve holder cup 3. The valve body 5 is hollow and closed at its upper end by a seal disk 6. Output tube 7 of an atomizer or spray head 8 extends through an opening in disk 6 and is slidable inside the valve body. In the output tube 7 is a central duct 9 which at its base is in communication with a radial duct 10; the duct 9 opens at its inner extremity into duct 10 and at its outer extremity to the exterior of atomizer 8. Output tube 7, at its lower portion, has a ring or collar 11 having a diameter slightly greater than that of output tube 7. The annular shoulder at the top of ring 11 is pressed, when valve 4 is closed, against the seal disk 6 by a helical compression spring 12. This spring is between the lower surface of ring 11 of the atomizer and an annular bearing surface at the lower part of the valve body and on which the spring seats. Mounted on the upper part of the output tube 7 is a push button 13 comprising a dispensing duct 14 furnished with an atomizing nozzle 15.

The lower portion of valve 4 extends to provide a sleeve 16 into which a plunger tube 17 extends and is secured. The sleeve 16 provides means for connecting the plunger tube 17 to the inlet of valve 4. One of the essential characteristics of this valve is that the duct 18 defined by the feed tube 17 is provided, at its lower extremity, remote from the valve body, with a restrictor 19 made of a rigid material having a passage 20 which is of quite small size in relation to the cross-section of duct 18 of the feed tube. In this embodiment, restrictor 19 causes a great loss of pressure of the fluid flowing to the inside of feed tube 17. Restrictor 19 is in the form of a plug joined at its periphery to the wall of the feed tube 17. The passage 20 is circular, has a radius 0.1 mm, and a length of 5 mm. The feed tube is 30 cm long. The feed tube 17 is 30 cm long and the duct 18 has an inside diameter of 6.4 mm.

Another unique feature of the device according to the invention is that plunger 17 is made of an elastically deformable material such as Buna or Neoprene, for example. As will be explained hereafter in detail, the dosage or metering device of valve 4, that is to say the device which permits the dispensing of a predetermined quantity at each operation of the valve, comprises feed tube 17 with deformable walls and the restrictor 19 which partially blocks the duct of the tube.

In this embodiment, the product to be dispensed is a liquid cosmetic product mixed in the liquid phase with a liquified propellant in the liquid-vapor stage at normal temperatures of use, such as a mixture of chlorofluoroalcanes, for example.

The vapor phase of the propellant is contained in the upper part of the pressurized container vertically above the heavier liquid stage in mixture with the product to be dispensed which is contained in the lower part of the container, in the tubing 18 and in the valve body 5. The inner volume of the duct 18 and the free inner volume of the valve body 5 constitute the dosage volume, i.e. the volume dispensed when push button 13 is depressed.

When the valve is in its closed state of rest, ring or collar 11 is pushed by the spring 12 against the wall of the seal disk 6. The pressure of ring 11 seals the container below the passage 10 and, consequently, the sealing between the interior of the pressurized container and the exterior is assured; the interior volume of tube 17 and of the valve body 5 contain the dose of product to be dispensed in mixture with the liquid phase of the propellant.

When the user presses on push button 13, he pushes the spray head 8 inside valve body 5, then spacing collar 11 from its seat on the lower surface of seal disk 6, which permits the product contained in feed tube 17 and in the valve body 5 to be dispensed by passage from duct 18, valve body 8, passages 10, 9 and 14 and the atomizing nozzle 15.

This expulsion of the product contained inside the dosage volume is carried out not only because of the presence of the propellant in the liquid phase which is mixed with the product to be dispensed but also because of pressure forces schematically shown by the arrows 21 in FIG. 2, these pressure forces resulting from the internal pressure of the container and exceeding the pressure in feed tube 17 because of the pressure drop across passage 20 (when the dispensing valve is open). These pressure forces cause the squashing of the supply deformable wall of feed tube 17 and consequently the ejection of the quantity of product contained in duct 18. When the user now presses the output tube 7 of the valve, the dispensing of the product continues until the moment when the squashing of the walls of the feed tube is such that tube 17 is completely closed. At this instant, dispensing ceases even if the valve is kept open.

When the user releases the push button, collar 11 again seats against the seal disk 6: the valve is then closed; the mixture (product to be dispensed and fluid propellant) can again pass into duct 18 through passage 20 bored in restrictor 19 and, when the pressures equalize between the exterior and the interior of the feed tube, the wall of the tube elastically returns to its original shape. The dosage volume being again filled by the product to be dispensed, a new predetermined quantity of product can be then again dispensed by pressing on push button 13. It is thus evident that a means for dispensing a predetermined quantity of product each time the dispensing valve 4 is opened is provided by the flexible feed tube 17 with one end in the container, and the restrictor means in the form of restrictor passage 20, by virtue of the connection of the tube 17 to inlet sleeve 16 of the valve. Also, a length of the feed tube which is collapsed provides a means for sealing the tube 17 and the container after an initial opening of the valve, so long as the valve is maintained open.

It is clear that the metering valve according to the invention, is of very low cost in relation to dosage or metering valves of known construction, it being understood that it is a result simply of the association of a dispensing valve of the conventional (nonmetering) type and a feed tube with supple deformable walls having an obstruction at its free extremity. Moreover, it is fitting to remark that the dose of product to be dispensed depends essentially on the interior volume of the plunger tube. One can thus mass produce pressurized containers for dispensing different measured volumes of product by equipping them with the same valve body 5 and the same spray head 8 and varying the length or the cross section of the feed tube in them to obtain the dose of product that one desires to dispense in each case. Finally, as for conventional valves not equipped with the dosage device, the filling of the pressurized container of the invention can be carried out before or after the valve is put in place, and refilling can also be done.

It is of course understood that the embodiment described above is in no way limiting and can be modified in any desirable way without going beyond the scope of the invention.

What is claimed is:

1. A metering arrangement for a pressurized dispensing container characterized by the fact that the container dispenses only a predetermined quantity of the product from the container each time its dispensing valve is actuated, comprising in combination, a dispensing valve heating an outlet through which the dispensed product flows, and an inlet, and means for dispensing a predetermined quantity of product each time the dispensing valve is operated and comprising, a flexible feed tube having one end within the container, means for connecting the other end of the tube to the inlet of said valve, and restrictor means on said tube and spaced from the valve for restricting flow of product from the container into the tube, said flexible feed tube having a substantial length thereof between said restrictor means and said valve, said length being exposed to the pressure in the container and collapsing as a result of pressure in the container to dispense said predetermined quantity of the product when the valve is opened, said collapsed length comprising means for sealing said tube after an initial opening of the valve so long as the valve is maintained open, so that only said predetermined quantity of product is dispensed each time the valve is opened.

2. Metering arrangement according to claim 1, characterized by the fact that said restrictor means is at a free extremity of the feed tube.

3. Metering arrangement according to claim 1, characterized by the fact that said restrictor means comprises a plug having a restriction passage therein, said plug being a close fit in said feed tube.

4. Metering arrangement according to claim 3, characterized by the fact that the restriction passage has a length which is large in relation to the maximum dimension of its cross section.

5. Metering arrangement according to claim 3, characterized by the fact that the restriction passage has a cross-section equal to s and the feed tube has an interior cross-section equal to S, where the ratio s/S is included between 1/400 and 1/150.

6. Metering arrangement according to claim 3, characterized by the fact that the restriction passage has a circular section of radius R, and a length of 1, and the ratio R/1 is included between 1/50 and 1/25.

7. Pressurized container of the "aerosol bomb" type including the metering arrangement of claim 1, the said can containing both the product to be dispensed and at least one propellant fluid.

8. Pressurized container according to claim 7, characterized by the fact that the propellant fluid is a liquified propellant in the liquid state at normal temperatures of use of the pressurized container, the liquid of the fluid propellant being mixed with the product to be dispensed.

9. Pressurized container according to claim 7, characterized by the fact that the propellant fluid is a compressed nonliquified gas at normal temperatures of use of the container.

10. Pressurized container according to claim 7, wherein the propellant fluid is a liquified propellant in the liquid-vapor state at normal temperatures of use of the pressurized container, the liquid phrase of the fluid propellant being mixed with the product to be dispensed.

* * * * *